US011585116B2

(12) United States Patent
Riley et al.

(10) Patent No.: US 11,585,116 B2
(45) Date of Patent: Feb. 21, 2023

(54) ANTI-LIGATURE LEVER

(71) Applicant: SARGENT MANUFACTURING COMPANY, New Haven, CT (US)

(72) Inventors: Daniel W. Riley, Meriden, CT (US); Richard D. Sangster, Jr., Madison, CT (US)

(73) Assignee: SARGENT MANUFACTURING COMPANY, New Haven, CT (US)

( * ) Notice: Subject to any disclaimer, the term of this patent is extended or adjusted under 35 U.S.C. 154(b) by 526 days.

(21) Appl. No.: 16/579,196

(22) Filed: Sep. 23, 2019

(65) Prior Publication Data

US 2020/0102768 A1 Apr. 2, 2020

Related U.S. Application Data

(60) Provisional application No. 62/740,211, filed on Oct. 2, 2018.

(51) Int. Cl.
*E05B 15/00* (2006.01)
*E05B 3/06* (2006.01)

(52) U.S. Cl.
CPC ..... *E05B 3/065* (2013.01); *E05B 15/0033* (2013.01); *E05Y 2900/132* (2013.01); *Y10T 292/93* (2015.04)

(58) Field of Classification Search
CPC ... Y10T 292/82; Y10T 292/85; Y10T 292/88; Y10T 292/93; Y10T 292/96;
(Continued)

(56) References Cited

U.S. PATENT DOCUMENTS 2,729,485 A * 1/1956 Schlage ..... E05B 3/065 267/180
4,343,502 A * 8/1982 Nelson ..... E05B 3/06 74/548
(Continued)

FOREIGN PATENT DOCUMENTS

DE 2257681 A1 * 5/1974
DE 102005001445 A1 * 7/2006 ..... E05B 3/065
(Continued)

*Primary Examiner* — Carlos Lugo
(74) *Attorney, Agent, or Firm* — DeLio Peterson & Curcio LLC; David R. Pegnataro

(57) ABSTRACT

An anti-ligature lock having a locking mechanism for retracting a latch between a locked and an unlocked position. The anti-ligature lock includes a lock handle rotatable about the axis and operatively connected to a lock mechanism hub to rotate the hub and retract the latch between the locked and the unlocked positions. The anti-ligature lock includes a connector between the hub and the lock handle and rotatable about the axis, the connector having a female portion having an opening with walls elongated in a direction normal to the axis and a male portion having projections extending in opposite directions normal to the axis, the male portion extending within the female portion opening and having a neutral position wherein one of the male or female portion may be partially rotated in either direction about the axis with respect to the other of the male or female portion without the male portion projections contacting the female portion opening walls.

16 Claims, 12 Drawing Sheets

(58) Field of Classification Search
CPC .... E05B 15/0033; E05B 15/004; E05B 3/065; E05B 2001/0076; Y10S 292/61
USPC ..... 292/347, 358, 359
See application file for complete search history.

(56) References Cited

U.S. PATENT DOCUMENTS 4,728,133 A * 3/1988 Valley ..... E05B 3/06 292/DIG. 60
4,784,417 A * 11/1988 Fleming ..... E05B 3/065 292/357
5,029,914 A * 7/1991 Hankel ..... E05B 3/06 292/336.5
5,718,468 A * 2/1998 Qureshi ..... E05B 63/0056 292/357
6,857,300 B1 * 2/2005 Heeley ..... E05B 13/004 70/210
6,869,116 B2 * 3/2005 Dalsing ..... E05B 13/005 292/336.3
6,916,053 B2 * 7/2005 Lin ..... E05B 63/006 292/336.5
7,900,978 B2 * 3/2011 Zimmer ..... E05B 3/065 292/336.3
8,430,436 B2 * 4/2013 Shi ..... E05B 65/0017 292/347
8,534,723 B2 * 9/2013 Berger ..... E05B 13/005 292/336.3
9,404,284 B2 * 8/2016 Stendal ..... E05B 63/16

FOREIGN PATENT DOCUMENTS

FR 3004207 A1 * 10/2014 ..... E05B 15/004
GB 923017 A * 4/1963
GB 1496934 A * 1/1978 ..... E05B 3/065
GB 2095788 A * 10/1982 ..... E05B 3/065
GB 2150629 A * 7/1985 ..... E05B 3/065
GB 2408773 A * 6/2005 ..... E05B 13/106

* cited by examiner

ANTI-LIGATURE LEVER

BACKGROUND OF THE INVENTION

1. Field of the Invention

The present invention relates generally to anti-ligature lock mechanisms, escutcheons and door handles designed to prevent suicide by preventing the securing of a ligature to the door handle or the lock mechanism.

2. Description of Related Art

Buildings such as hospitals, mental health facilities, prisons, detention centers and the like are locations where patients, inmates and detainees are subject to stress and high levels of emotion. Under such circumstances, there is an increased risk of suicide by those within.

A common type of attempted suicide or self-harm is by hanging or strangulation by attaching a ligature, such as clothing or a belt to a conventional door knob or lever handle. Because it is not possible for all patients and inmates to be continuously monitored, public buildings of the aforementioned type are increasingly being provided with specially designed anti-ligature locks and door handles. The use of such anti-ligature locks and handles can significantly reduce or eliminate the occurrence of sentinel events, i.e., suicide and/or self-inflicted injuries.

A conventional knob or lever handle allows clothing or a belt to be attached to the handle of the lock mechanism. Anti-ligature locks and door handles function by eliminating projections and hanging points, which prevents clothing or belts from being attached to the handle.

Conventional anti-ligature lock handles may provide enough resistance in turning the lever that clothing attached can be used to self-inflict injury. There is a need for an anti-ligature lock handle design that offers little resistance in most of the lever positions.

SUMMARY OF THE INVENTION

Bearing in mind the problems and deficiencies of the prior art, it is therefore an object of the present invention to provide an anti-ligature lock having a door handle that does not allow the end of a ligature to be secured to the handle.

It is another object of the present invention to provide an anti-ligature lock having a door handle which does not resist rotational movement when the lever is at or near the horizontal position.

Still other objects and advantages of the invention will in part be obvious and will in part be apparent from the specification.

The above and other objects, which will be apparent to those skilled in the art, are achieved in the present invention which is directed to an anti-ligature lock comprising a locking mechanism for retracting a latch between a locked and an unlocked position, the lock mechanism having a hub rotatable about an axis. The anti-ligature lock includes a lock handle rotatable about the axis and operatively connected to the hub to rotate the hub and retract the latch between the locked and the unlocked positions and a connector between the hub and the lock handle and rotatable about the axis, the connector having a female portion having an opening with walls elongated in a direction normal to the axis and a male portion having projections extending in opposite directions normal to the axis, the male portion extending within the female portion opening and having a neutral position wherein one of the male or female portion may be partially rotated in either direction about the axis with respect to the other of the male or female portion without the male portion projections contacting the female portion opening walls, the male portion and opening walls being configured such that after the male or female portion are partially rotated about the axis in either direction with respect to the other, the male portion projections contact the female portion opening walls so that the male portion projections mate with the female portion opening walls for driving engagement between the two to enable the lock handle to rotate the locking mechanism hub. The anti-ligature lock may include a resilient member in the lock handle holding the lock handle in a neutral position wherein, upon application of force in one direction to the handle while in the neutral position, the handle partially rotates in the one direction about the axis from the neutral position to the predetermined angular position while flexing the resilient member without causing the hub to rotate and, upon reaching the predetermined angular position and continuing application of the force, the connector male portion projections contact the female portion opening walls so that the male portion projections mate with the female portion opening walls for driving engagement between the two to enable the lock handle to rotate the locking mechanism hub and retract the latch or deadbolt from the locked to the unlocked position, and upon release of the force in the one direction, the handle returns to the neutral position by urging of the at least one resilient member and the latch or deadbolt returns to the locked position. The resilient member may be located in a cartridge rotatable with the lock handle and permitting the lock handle, upon application of force, to partially rotate in either direction about the axis from a neutral position to a predetermined angular position and, upon release of the force, return to the neutral position. The anti-ligature lock may include a second resilient member which resists rotation of the lock handle in the opposite direction as the first resilient member. The first resilient member may be a spring. Upon application of force in the other direction to the handle while in the neutral position, the handle may partially rotate in the one direction about the axis from the neutral position to the predetermined angular position without causing the hub to rotate and, upon reaching the predetermined angular position and continuing application of the force, the connector male portion projections may contact the female portion opening walls so that the male portion projections mate with the female portion opening walls and the handle is prevented from further rotation, without retracting the latch or deadbolt, and upon release of the force in the other direction, the handle returns to the neutral position. Upon application of force in the other direction to the handle while in the neutral position, the handle may partially rotate in the one direction about the axis from the neutral position to the predetermined angular position while flexing the at least one resilient member without causing the hub to rotate and, upon reaching the predetermined angular position and continuing application of the force, the connector male portion projections may contact the female portion opening walls so that the male portion projections mate with the female portion opening walls and the handle is prevented from further rotation, without retracting the latch or deadbolt, and upon release of the force in the other direction, the handle returns to the neutral position by urging of the at least one resilient member. The resilient member may be disposed in a cartridge rotatable with the lock handle and permitting the lock handle, upon application of force, to partially rotate in either direction about the axis from a neutral position to a predetermined angular position and, upon release of the force, return to the neutral position.

The present invention also provides a connector for a lock between a lock hub and a lock handle and rotatable about an axis, the connector comprising a female portion having an opening with walls elongated in a direction normal to the axis and a male portion having projections extending in opposite directions normal to the axis, the male portion extending within the female portion opening and having a neutral position wherein one of the male or female portion may be partially rotated in either direction about the axis with respect to the other of the male or female portion without the male portion projections contacting the female portion opening walls, the male portion and opening walls being configured such that after the male or female portion are partially rotated about the axis in either direction with respect to the other, the male portion projections contact the female portion opening walls so that the male portion projections mate with the female portion opening walls for driving engagement between the two to enable the lock handle to rotate the locking mechanism hub.

The present invention also provides a lock connector for use between a lock hub and a lock handle, the lock connector comprising a connector adapter including a cylindrical base portion having a central axis, a female portion having an opening with walls extending in a first direction from the base portion, the first direction normal to the central axis, the walls including substantially cylindrical portions and a pair of substantially flat portions between the cylindrical portions and a male portion extending in second direction opposite the first direction and normal to the central axis, the male portion engagable with a door lock hub for sliding a door latch from a door securing position. The lock connector includes an elongated spindle having a first spindle end engagable with a door handle and a second spindle end opposite the first spindle end, the second spindle end extending within the female portion opening and having a neutral position wherein the spindle may be partially rotated in either direction about the axis with respect to the female portion without rotating the female portion. The second spindle portion may include projections which contact the opening flat walls subsequent to the spindle being partially rotated in either direction and further rotation rotates the bushing adapter for sliding the door latch from the door securing position. The second spindle end and opening walls may be configured such that after the second spindle end is partially rotated about the axis in either direction with respect to the female portion, a pair of spindle projections extending perpendicular to the central axis on the second spindle end contact the female portion opening flat walls so that the projections mate with the female portion opening flat walls for driving engagement between the spindle and the bushing adapter to enable the lock handle to rotate the door lock hub.

The present invention also provides a cartridge for a door lock for mounting on a door, the cartridge comprising a cartridge housing having an arcuate channel extending therethrough, the cartridge housing being rotatable with respect to the door, a first spring disposed in a first portion of the cartridge housing arcuate channel and a second spring disposed in a second portion of the cartridge housing arcuate channel. The cartridge is adapted to engage a bias fastener stationary with respect to the door, the bias fastener extending into the arcuate channel between adjacent ends of the first spring and the second spring, the cartridge having a neutral angular position with respect to the door when no external forces are applied to the cartridge. The cartridge may be rotated by a force whereby one of the springs is compressed and the cartridge returns to the neutral position when the force is removed. The cartridge may include a cartridge housing plate secured to the cartridge housing and covering the arcuate channel in the cartridge housing, the cartridge housing plate securable to a door handle. The cartridge plate may include an arcuate slot adjacent the arcuate channel wherein the first and second spring slidingly engage the arcuate channel and the arcuate slot. The bias fastener may extend from the door lock housing, through the cartridge plate arcuate slot and into the arcuate channel. The cartridge may include a cap disposed on adjacent ends of the resilient members for engaging a bias fastener.

The present invention also provides a lock comprising a locking mechanism having a hub rotatable about an axis to retract a latch or deadbolt between locked and unlocked positions, a lock handle rotatable by a user about the axis and operatively connected to the hub to rotate the hub and retract a latch or deadbolt between locked and unlocked positions and at least one resilient member in the lock handle holding the lock handle in a neutral position, the at least one resilient member being located in a cartridge rotatable with the lock handle and permitting the lock handle, upon application of force, to partially rotate in either direction about the axis from a neutral position to a predetermined angular position and, upon release of the force, return to the neutral position. The lock includes a connector between the hub and the lock handle and rotatable about the axis, the connector having a female portion having an opening with walls elongated in a direction normal to the axis and a male portion having projections extending in opposite directions normal to the axis, the male portion extending within the female portion opening and having a neutral position wherein one of the male or female portion may be partially rotated in either direction about the axis with respect to the other of the male or female portion without the male portion projections contacting the female portion opening walls, the male portion and opening walls being configured such that after the male or female portion are partially rotated about the axis in either direction with respect to the other, the male portion projections contact the female portion opening walls so that the male portion projections mate with the female portion opening walls for driving engagement between the two to enable the lock handle to rotate the locking mechanism hub. Upon application of force in one direction to the handle while in the neutral position, the handle partially rotates in the one direction about the axis from the neutral position to the predetermined angular position while flexing the at least one resilient member without causing the hub to rotate and, upon reaching the predetermined angular position and continuing application of the force, the connector male portion projections contact the female portion opening walls so that the male portion projections mate with the female portion opening walls for driving engagement between the two to enable the lock handle to rotate the locking mechanism hub and retract the latch or deadbolt from the locked to the unlocked position, and upon release of the force in the one direction, the handle returns to the neutral position by urging of the at least one resilient member and the latch or deadbolt returns to the locked position. Upon application of force in the other direction to the handle while in the neutral position, the handle partially rotates in the one direction about the axis from the neutral position to the predetermined angular position while flexing the at least one resilient member without causing the hub to rotate and, upon reaching the predetermined angular position and continuing application of the force, the connector male portion projections contact the female portion opening walls so that the male portion projections mate with the female portion opening walls and the handle is prevented from further rotation, without retracting the latch or deadbolt, and upon release of the force in the other direction, the handle returns to the neutral position by urging of the at least one resilient member. The at least one resilient member may be a pair of opposing resilient members in the lock handle.

The present invention also provides an anti-ligature lock comprising a locking mechanism for retracting a latch between a locked and an unlocked position, the lock mechanism having a hub rotatable about an axis and a lock handle rotatable about the axis and operatively connected to the hub to rotate the hub and retract the latch between the locked and the unlocked positions. The anti-ligature lock includes a connector between the hub and the lock handle and rotatable about the axis. The connector includes a connector adapter having a cylindrical base portion having a central axis, a female portion having an opening with walls extending in a first direction from the base portion, the first direction normal to the central axis, the walls including substantially cylindrical portions and a pair of substantially flat portions between the cylindrical portions and a male portion extending in second direction opposite the first direction and normal to the central axis, the male portion engagable with a door lock hub for sliding a door latch from a door securing position. The anti-ligature lock includes an elongated spindle having a first spindle end engagable with a door handle and a second spindle end opposite the first spindle end, the second spindle end extending within the female portion opening and having a neutral position wherein the spindle may be partially rotated in either direction about the axis with respect to the female portion. Upon application of force in one direction to the handle while in the neutral position, the handle partially rotates in the one direction about the axis from the neutral position to the predetermined angular position while flexing the at least one resilient member without causing the hub to rotate and, upon reaching the predetermined angular position and continuing application of the force, the connector male portion projections contact the female portion opening walls so that the male portion projections mate with the female portion opening walls for driving engagement between the two to enable the lock handle to rotate the locking mechanism hub and retract the latch or deadbolt from the locked to the unlocked position, and upon release of the force in the one direction, the handle returns to the neutral position by urging of the at least one resilient member and the latch or deadbolt returns to the locked position. The anti-ligature lock may include a cartridge comprising a cartridge housing having an arcuate channel extending therethrough, the cartridge housing being rotatable with respect to the door, a first spring disposed in a first portion of the cartridge housing arcuate channel and a second spring disposed in a second portion of the cartridge housing arcuate channel. The cartridge may be adapted to engage a bias fastener stationary with respect to the door, the bias fastener extending into the arcuate channel between adjacent ends of the first spring and the second spring, the cartridge having a neutral angular position with respect to the door when no external forces are applied to the cartridge. The cartridge may be rotated by a force whereby one of the springs is compressed and the cartridge returns to the neutral position when the force is removed.

The present invention also provides a method for using an anti-ligature lock comprising providing a locking mechanism for retracting a latch between a locked and an unlocked position, the lock mechanism having a hub rotatable about an axis, providing a lock handle rotatable about the axis and operatively connected to the hub to rotate the hub and retract the latch between the locked and the unlocked positions and providing a connector between the hub and the lock handle and rotatable about the axis, the connector having a female portion having an opening with walls elongated in a direction normal to the axis and a male portion having projections extending in opposite directions normal to the axis, the male portion extending within the female portion opening and having a neutral position. The method includes partially rotating one of the male or female portion in either direction about the axis with respect to the other of the male or female portion without the male portion projections contacting the female portion opening walls and continuing rotation in the same direction of the one of the male or female portion, the male portion projections contacting the female portion opening walls so that the male portion projections mate with the female portion opening walls for driving engagement between the two to enable the lock handle to rotate the locking mechanism hub. The method for using an anti-ligature lock may include providing a resilient member in the lock handle holding the lock handle in a neutral position wherein, upon application of force in one direction to the handle while in the neutral position, the handle partially rotates in the one direction about the axis from the neutral position to the predetermined angular position while flexing the at least one resilient member without causing the hub to rotate and, upon reaching the predetermined angular position and continuing application of the force, the connector male portion projections contact the female portion opening walls so that the male portion projections mate with the female portion opening walls for driving engagement between the two to enable the lock handle to rotate the locking mechanism hub and retract the latch or deadbolt from the locked to the unlocked position, and upon release of the force in the one direction, the handle returns to the neutral position by urging of the at least one resilient member and the latch or deadbolt returns to the locked position.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1-23 of the drawings in which like numerals refer to like features of the invention.

Figure 1:
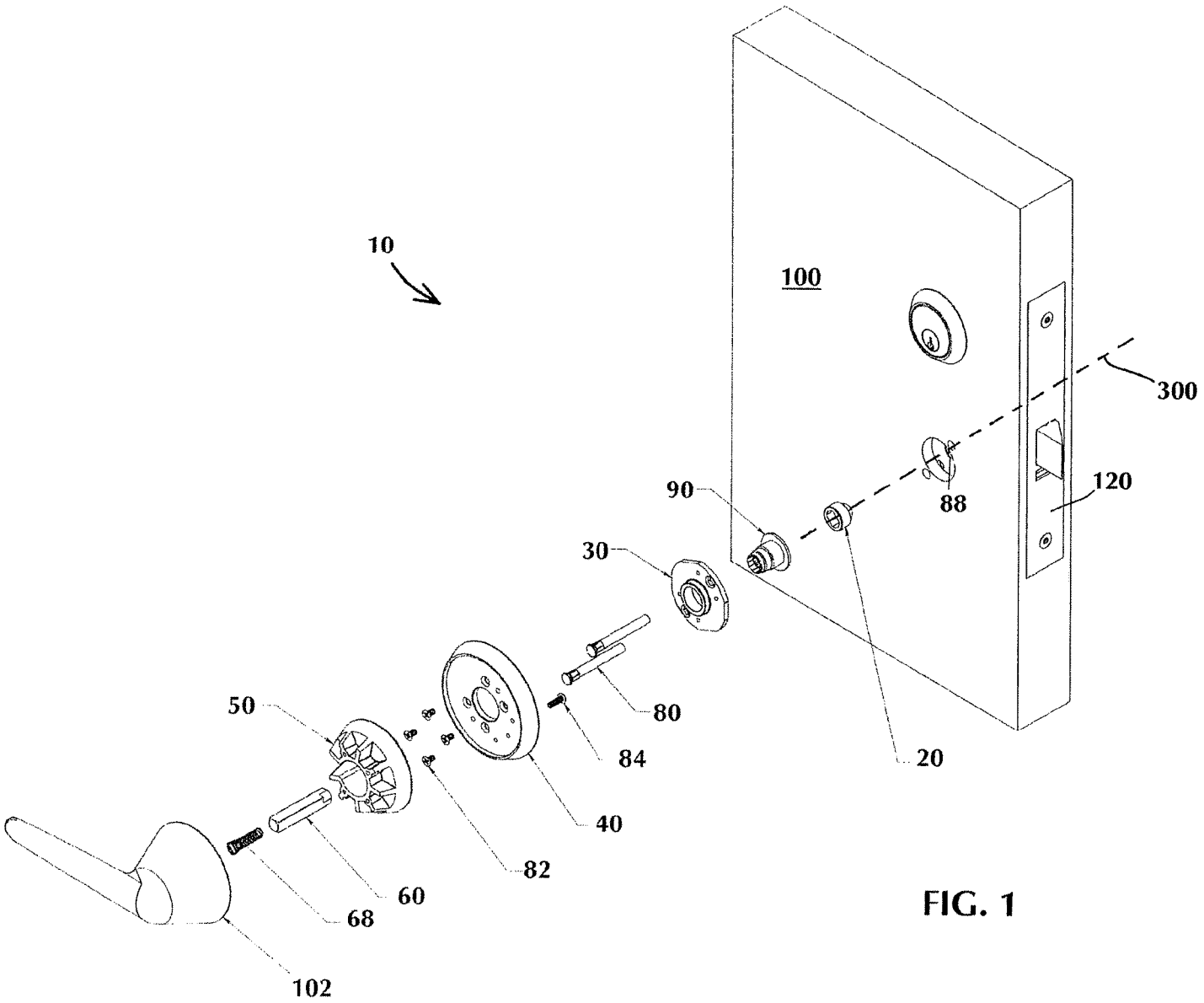
FIG. 1 is an exploded front right top perspective view of the anti-ligature lever according to the present invention.
Figures 2, 3:
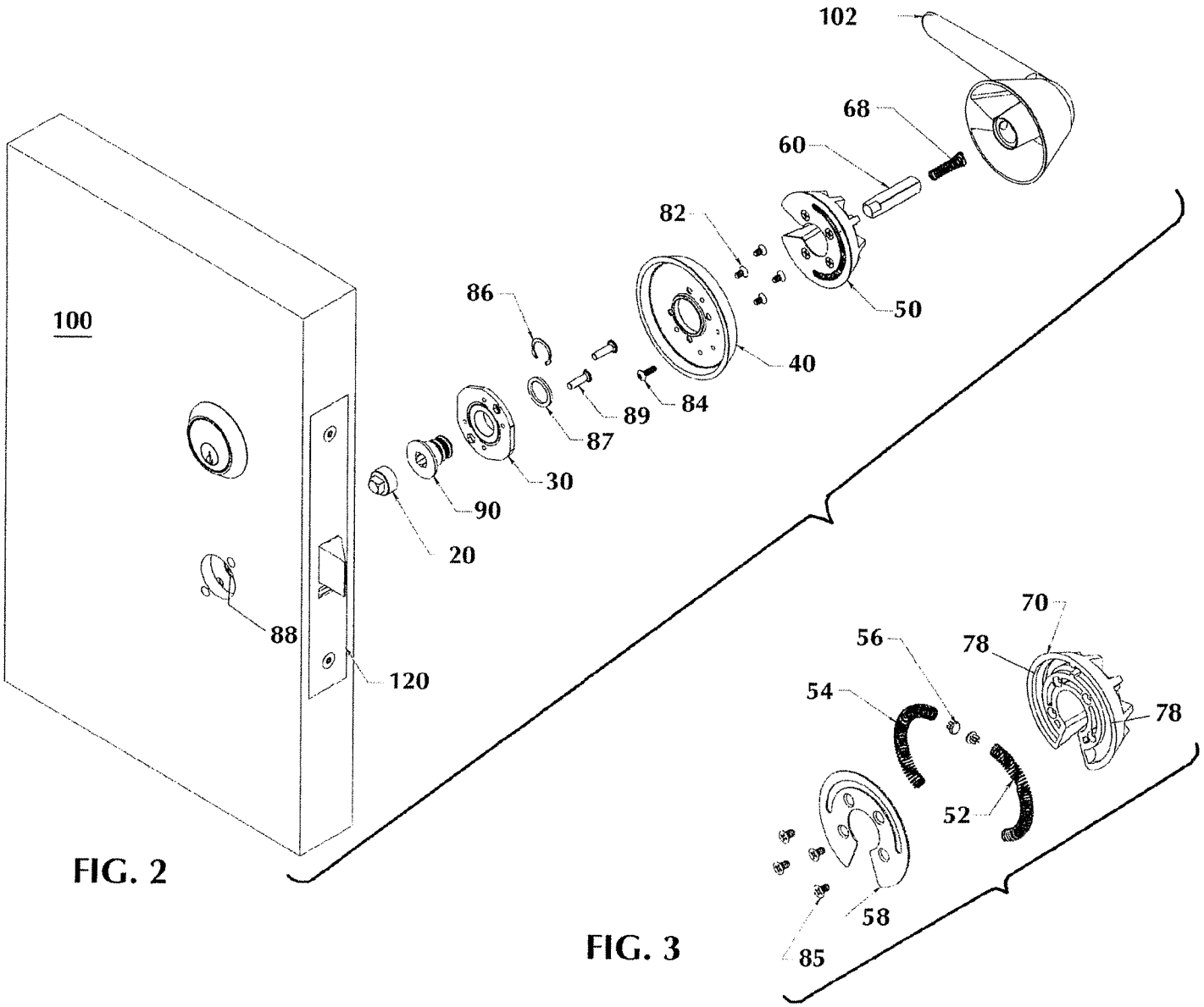
FIG. 2 is an exploded rear right top perspective view of the anti-ligature lever shown in FIG. 1.
FIG. 3 is an exploded view of the anti-ligature cartridge according to the present invention.

FIGS. 1 and 2 show the anti-ligature lever 10 attachable to a door 100 having a mortise lock or other locking mechanism 120. The locking mechanism 120 includes a locking hub 88 to which an adapter bushing 20 of the anti-ligature lever assembly 10 may be engaged. The locking mechanism hub 88 is rotatable about an axis 300 to retract a latch or deadbolt between locked and unlocked positions. The anti-ligature lever 10 includes a lock handle 102 rotatable by a user about the axis 300 and operatively connected to the hub 88 to rotate the hub 88 and retract a latch or deadbolt between locked and unlocked positions.

The anti-ligature lever 10 includes a bushing 90 for securing a spindle 60 about the axis 300. The handle 102 engages the spindle 60 and an anti-ligature cartridge 50 whereby rotation of the handle 102 rotates the spindle and cartridge 50 directly. A security rose 40 is disposed between the cartridge 50 and the door 100. A bias fastener 84 extends through the security rose 40 and engages the anti-ligature cartridge 50 whereby the cartridge 50 is biased in a neutral position with the attached handle in a horizontal position. An adapter plate 30 rotatably engages the bushing 90 and is secured to the door 100 using fasteners 80. The adapter plate 30 allows mounting of the security rose 40 to the door 100.

Figure 4A:
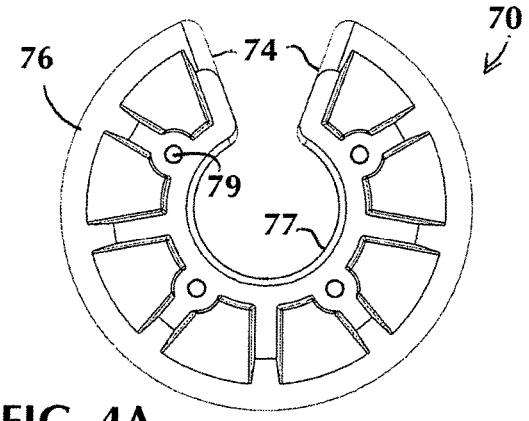
FIG. 4A is a front elevational view of the anti-ligature cartridge according to the present invention.
Figure 4B:
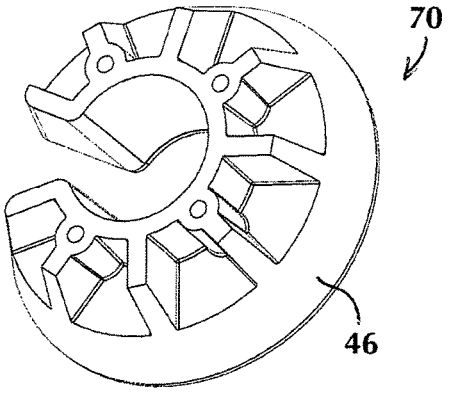
FIG. 4B is a front perspective view of the anti-ligature cartridge shown in FIG. 4A.
Figure 4C:
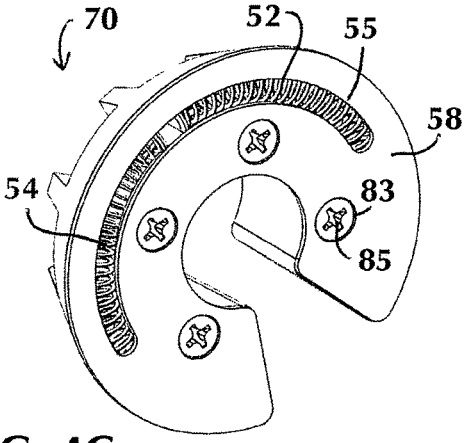
FIG. 4C is a rear perspective view of the anti-ligature cartridge shown in FIG. 4A.
Figure 4D:
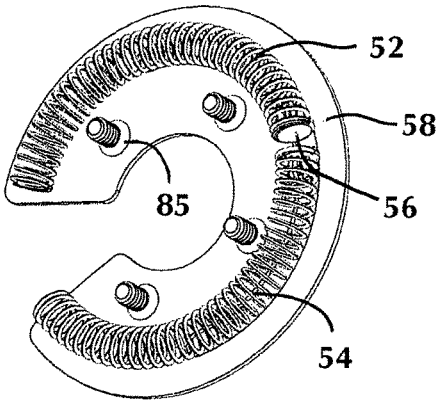
FIG. 4D is a front perspective view of the anti-ligature cartridge with the cartridge housing removed for clarity.
Figure 4E:
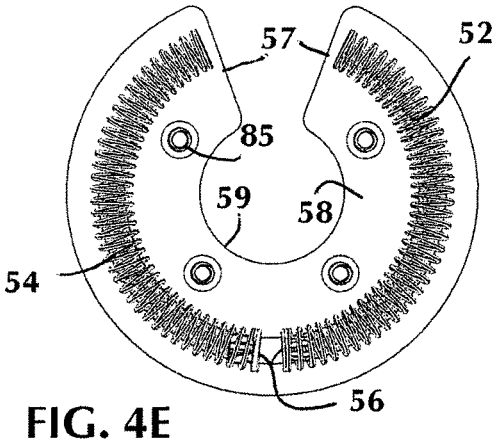
FIG. 4E is a front elevational view of the anti-ligature cartridge with the cartridge housing removed for clarity.
Figure 4F:
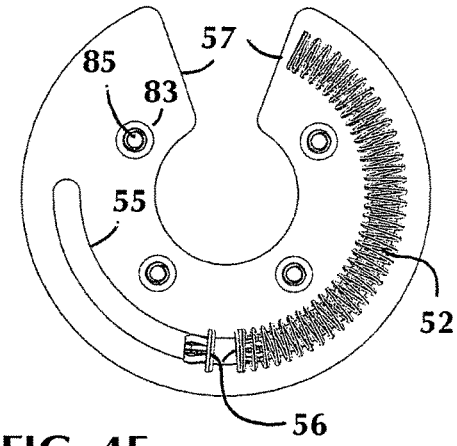
FIG. 4F is a front elevational view of the anti-ligature cartridge with the cartridge housing and one spring removed for clarity.
Figure 5A:
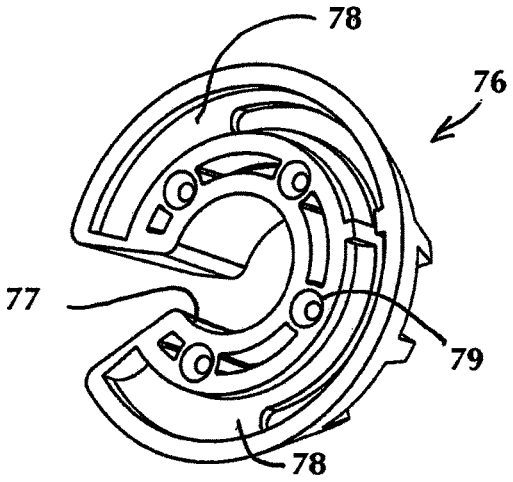
FIG. 5A is a perspective view of the cartridge housing according to the present invention.
Figure 5B:
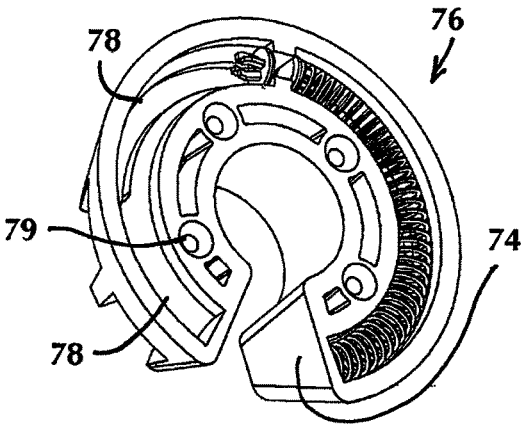
FIG. 5B is a perspective view of the cartridge housing with one of the springs shown and the second removed for clarity.
Figure 5C:
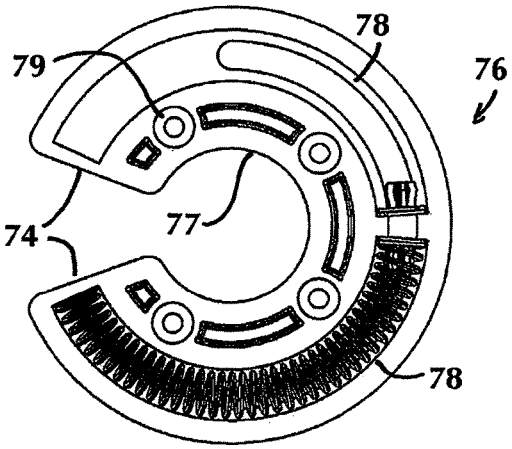
FIG. 5C is a rear elevational view of the cartridge housing with one of the springs shown and the second removed for clarity.
Figure 5D:
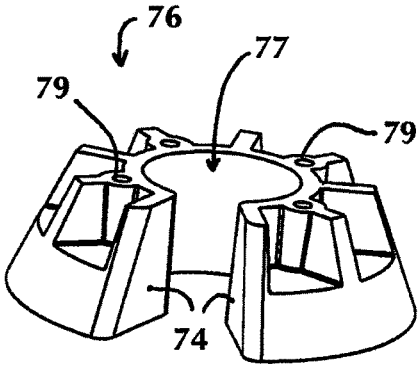
FIG. 5D is a perspective view of the outside of the cartridge housing according to the present invention.
Figure 5E:
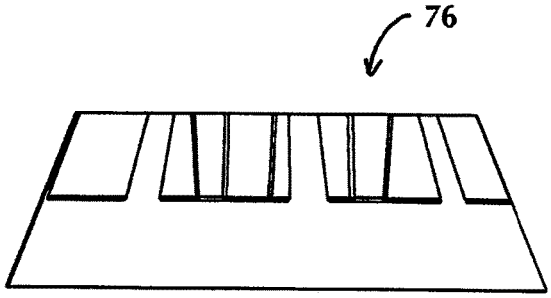
FIG. 5E is a side elevational view of the outside of the cartridge housing according to the present invention.
Figure 6A:
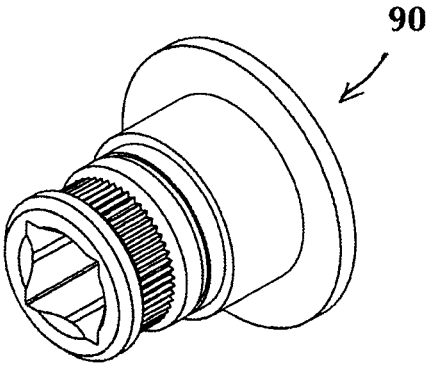
FIG. 6A is a front perspective view of the bushing according to the present invention.
Figure 6B:
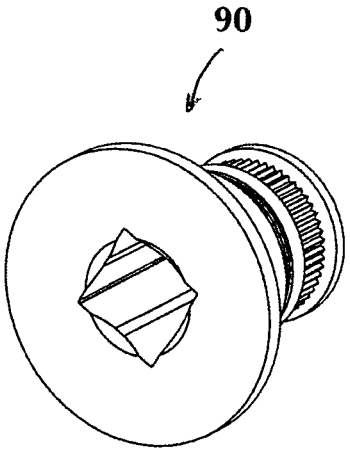
FIG. 6B is a rear perspective view of the bushing shown in FIG. 6A.
Figure 6C:
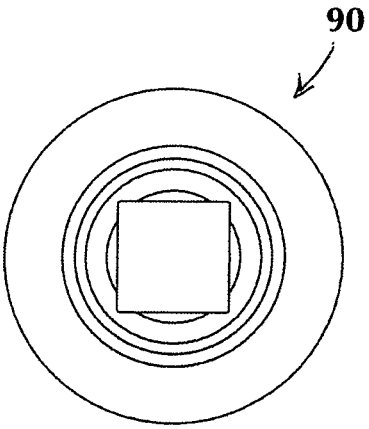
FIG. 6C is rear elevational view of the bushing shown in FIG. 6A.
Figure 6D:
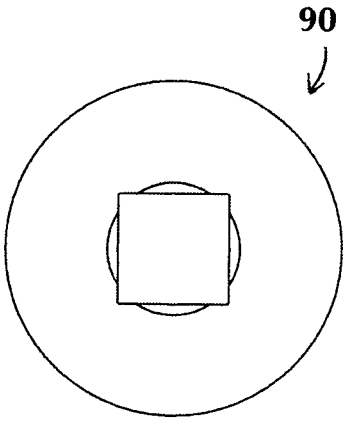
FIG. 6D is a front elevational view of the bushing shown in FIG. 6A.
Figure 7A:
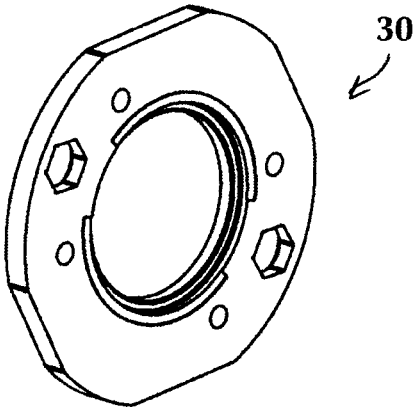
FIG. 7A is a front perspective of the housing plate according to the present invention.
Figure 7B:
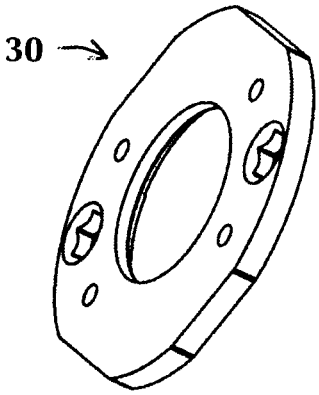
FIG. 7B is a rear perspective of the housing plate shown in FIG. 7A.
Figure 8A:
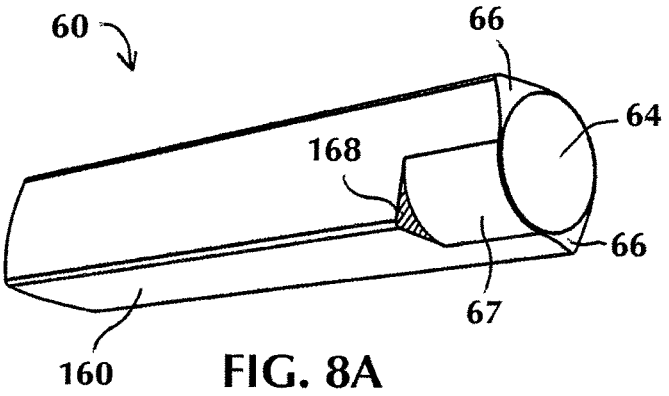
FIG. 8A is a rear perspective view of the spindle according to the present invention.
Figure 8B:
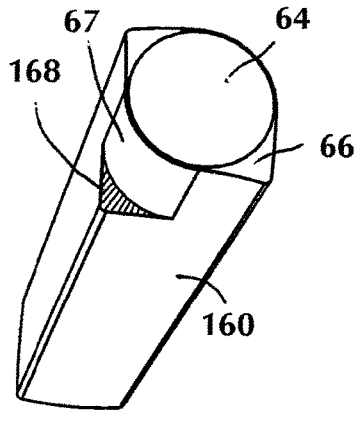
FIG. 8B is a rear perspective view of the spindle shown in FIG. 8A.
Figure 8C:
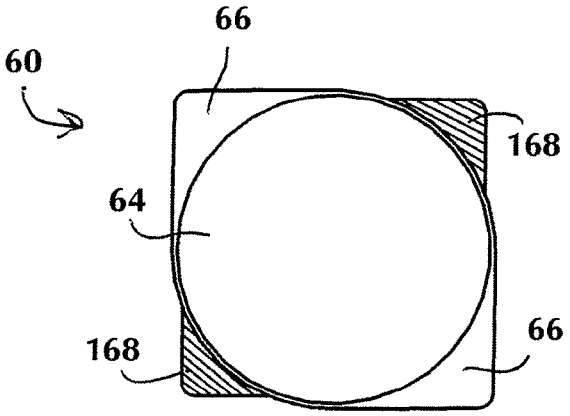
FIG. 8C is a rear elevational view of the spindle shown in FIG. 8A.
Figure 8D:
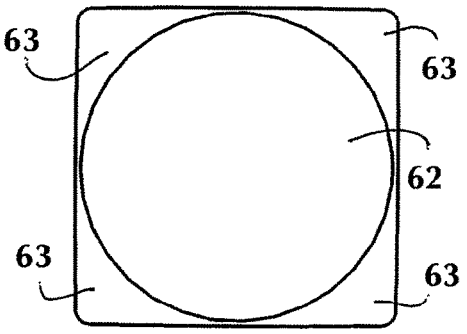
FIG. 8D is a front elevational view of the spindle shown in FIG. 8A.
Figure 8E:
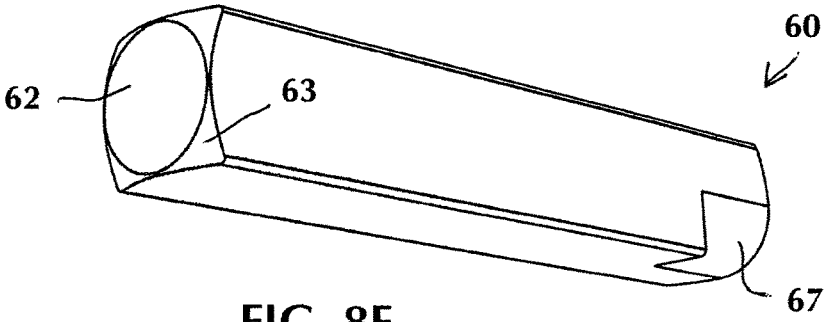
FIG. 8E is a perspective view of the spindle shown in FIG. 8A.

An exploded view of the anti-ligature cartridge 50 is shown in FIG. 3. FIGS. 4A-4C show the anti-ligature cartridge 70 and FIGS. 4D-4E show the cartridge with the cartridge housing 70 removed. At least one resilient member or spring 52 is disposed in the cartridge housing 70 and may slidingly engage cartridge housing grooves 78. Preferably, a pair of resilient members or springs 52, 54 is disposed in a cartridge housing 70 and slidingly engages in the cartridge housing grooves 78. FIG. 4F shows the cartridge with the housing and one spring removed. Caps 56 are disposed on one end of each spring 52, 54 and engage the bias fastener 84. Cartridge plate 58 secures the springs 52, 54 within the cartridge housing grooves 78. The cartridge 50 within the handle 102 engages the bias fastener 84, holding the lock handle 102 in a neutral position. The springs 52, 54 are located in the cartridge 50 are rotatable with the lock handle 102, permitting the lock handle 102 upon application of force to partially rotate in either direction about the axis 300 from a neutral position to a predetermined angular position and, upon release of the force, return to the neutral position. Spring 68 applies force to the spindle 60 along axis 300.

In another aspect of the cartridge 70 as shown in FIGS. 4A-4F and 5A-5E, the cartridge housing 76 includes an arcuate channel 78 extending substantially between housing ends 74. The cartridge housing 76 is attachable to the door handle and is rotatable with respect to the door. The first spring 52 is disposed in a first portion of the cartridge housing arcuate channel and the second spring is disposed in a second portion of the cartridge housing arcuate channel. The cartridge 70 is adapted to engage a bias fastener 84 stationary with respect to the door. The bias fastener 84 extends into the arcuate channel 78 between adjacent ends of the first spring and the second spring. The cartridge 70 has a neutral angular position with respect to the door when no external forces are applied to the cartridge 70. The cartridge 70 may be rotated by a force whereby one of the springs is compressed and the cartridge returns to the neutral position when the force is removed. The cartridge 70 includes a cartridge housing plate 58 shown in FIGS. 4C-4F, the cartridge housing plate 58 secured to the cartridge housing 46 and covers the arcuate channel 78 in the cartridge housing 46, the cartridge housing plate securable to a door handle. The cartridge housing plate 58 includes an arcuate slot 55 adjacent the arcuate channel 78 wherein the first and second spring 52, 54 slidingly engage the arcuate channel 78 and the arcuate slot 55. The bias fastener 84 extends from the door lock housing, through the cartridge plate arcuate slot 55 and into the arcuate channel 78. A cap 56 disposed on adjacent ends of the springs 52, 54 for engaging the bias fastener 84.

A connector male portion or spindle 60 shown in FIGS. 8A-8E includes a body 160 and an arm or projection 66 extending radially from the body for interaction with the walls 28 of the opening of the connector female portion 20. The spindle 60 includes a first end 62 having a substantially square cross section 63 and a spindle second end 64 having a circular profile shown as spindle cylindrical portions 67 with projections 66 extending radially from the cylindrical portion 67. Surfaces 63 may be disposed where the square profile and circular profile intersect.

Figure 9A:
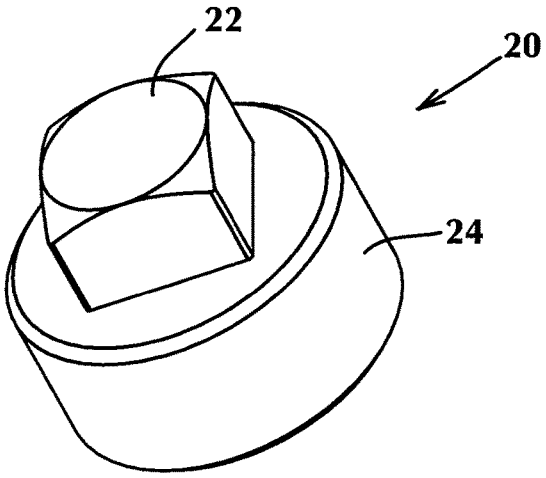
FIG. 9A is a rear perspective view of the adapter bushing according to the present invention.
Figure 9B:
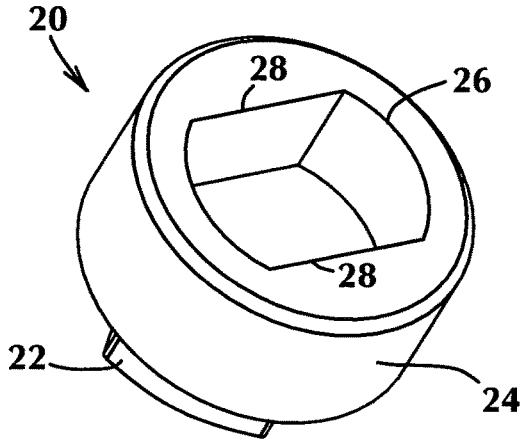
FIG. 9B is a front perspective view of the adapter bushing shown in FIG. 9A.
Figure 9C:
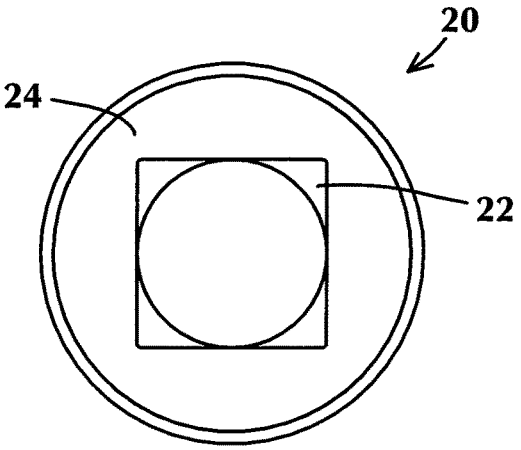
FIG. 9C is a front elevational view of the adapter bushing shown in FIG. 9A.
Figure 9D:
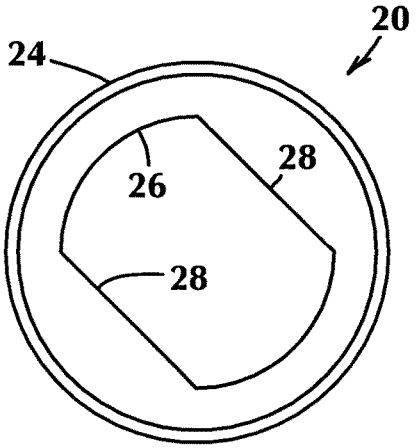
FIG. 9D is a rear elevational view of the adapter bushing shown in FIG. 9A.
Figure 10:
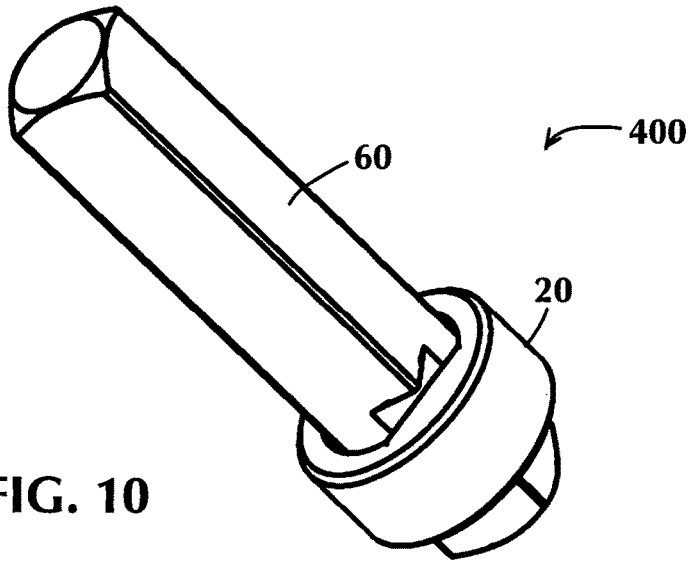
FIG. 10 is a perspective view of the spindle/bushing connector according to the present invention.
Figure 11A:
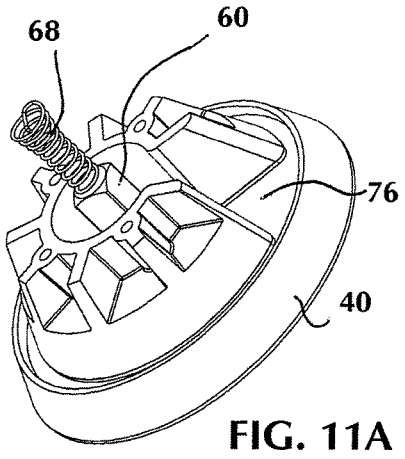
FIGS. 11A-11F are front bottom right perspective views of the anti-ligature cartridge shown in sequential layers.
Figure 11B:
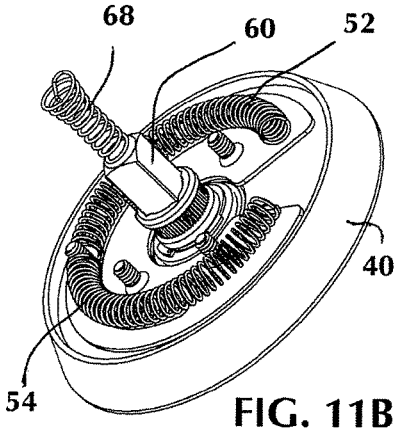
Figure 11C:
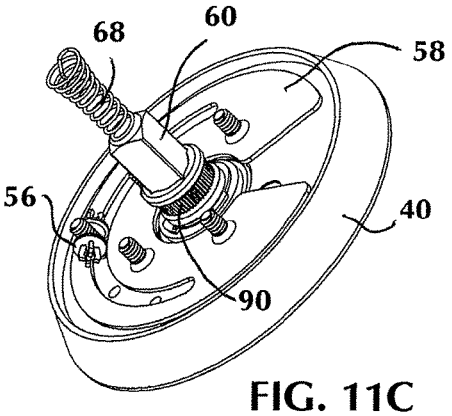
Figure 11D:
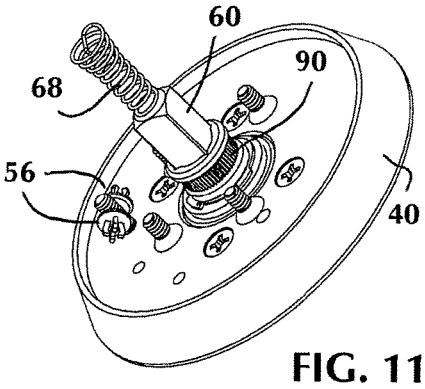
Figure 11E:
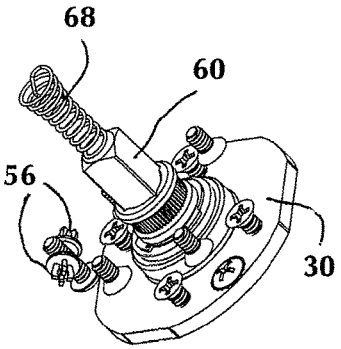
Figure 11F:
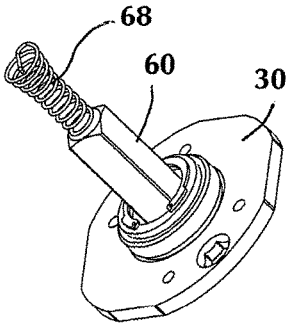
Figure 12:
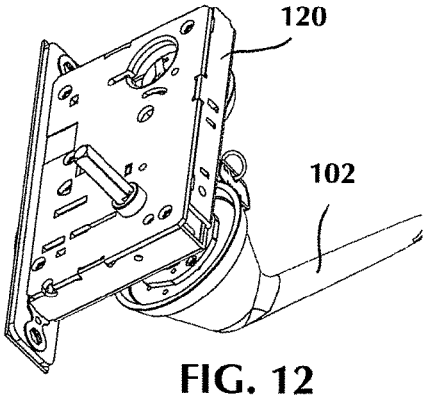
FIG. 12 is a perspective view of a mortise lock with the spindle/bushing connector shown engaged in the mortise lock hub on the front side and the full anti-ligature lever shown on the rear.
Figure 13A:
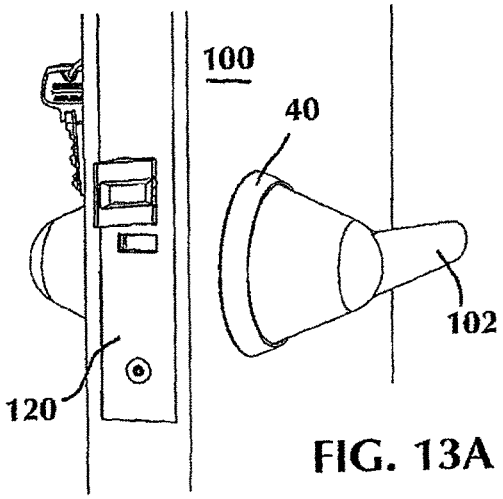
FIG. 13A is a perspective view of the anti-ligature lever mounted on a door.
Figure 13B:
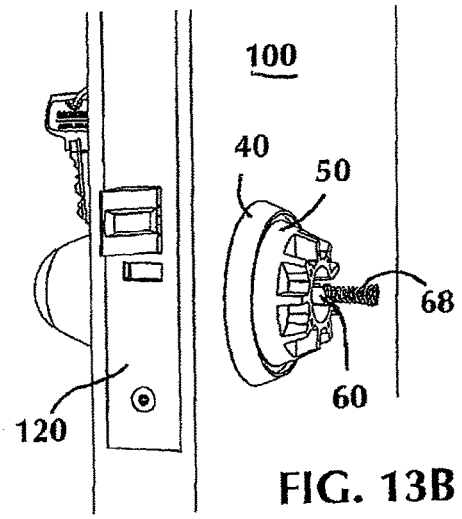
FIG. 13B is a perspective view of the anti-ligature lever shown in FIG. 13A with handle removed.
Figure 13C:
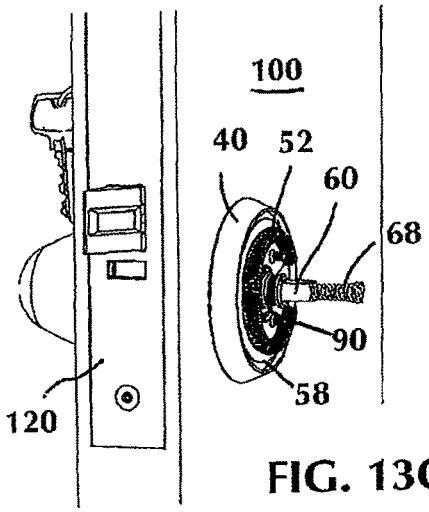
FIG. 13C is a perspective view of the anti-ligature lever shown in FIG. 13A with lever and cartridge housing removed.
Figure 14:
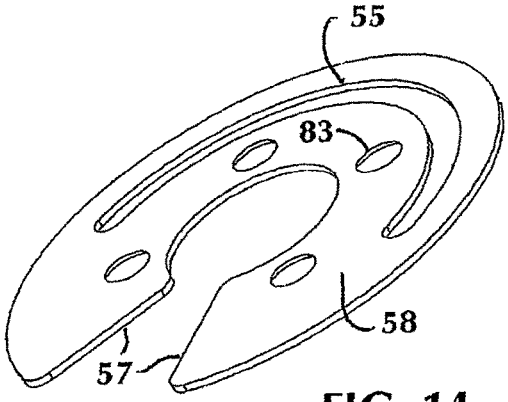
FIG. 14 is a perspective view of the cartridge plate according to the present invention.

A connector 400 shown in FIG. 10 includes the spindle 60 and an adapter bushing 20 shown in FIGS. 8A-8E and 9A-9D respectively. The connector 400 is disposed between the hub 88 and the lock handle 102 and rotatable about the axis 300. As best seen in FIGS. 9A-9B, the connector 400 adapter bushing 20 includes a female cylindrical base portion 24 having an opening 26 with walls 28 elongated in a direction normal to the axis 300 and a male portion 22 extending from base portion 24 in a direction opposite opening 26 for engaging locking mechanism hub 88. Connector 400 further includes spindle 60 having projections 66 extending in opposite directions normal to the axis 300 and engageable with the adapter bushing opening 26. The spindle 60 has a neutral position wherein one of the spindle or female cylindrical base portion may be partially rotated in either direction about the axis with respect to the other of the spindle or female cylindrical base portion without the spindle projections 66 contacting the female portion opening walls 28. The spindle and opening walls are configured such that after the spindle or female cylindrical base portion are partially rotated about the axis in either direction with respect to the other, the projections contact the female portion opening walls so that the spindle projections 66 mate with the female portion opening walls 28 for driving engagement between the two to enable the lock handle to rotate the locking mechanism hub 88.

Figure 15A:
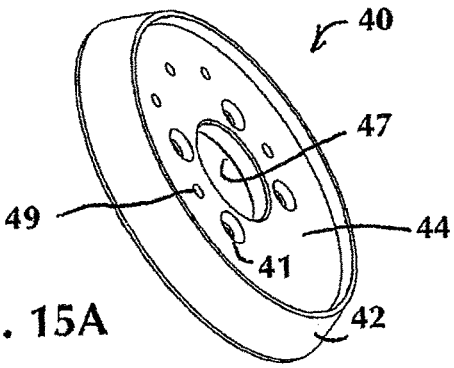
FIG. 15A is a front perspective view of the security rose according to the present invention.
Figure 15B:
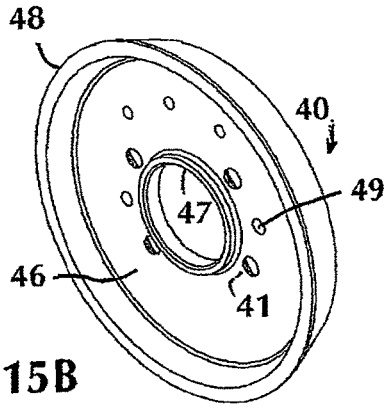
FIG. 15B is a rear perspective view of the security rose according to the present invention.

A security rose 40 is shown in FIGS. 15A and 15B. The security rose 40 includes a security rose opening 47 which allows the spindle 60 and bushing 90 to pass therethrough. The security rose 40 includes mounting fastener openings 41 for attaching the security rose 40 to the adapter plate 30 (FIGS. 11E and 11F) and securing openings 49 for securing the anti-ligature cartridge 50 to the security rose 40.

As shown in FIGS. 16-18 and 23, upon application of force in one direction to the handle 102 while in the neutral position, the handle 102 partially rotates in the one direction about the axis 300 from the neutral position to the predetermined angular position while flexing the springs 52, 54 without causing the hub 88 to rotate and, upon reaching the predetermined angular position and continuing application of the force, the connector male portion 60 projections contact the female portion 20 opening walls (FIGS. 9B and 9D) so that the male portion 60 projections 66 mate with the female portion opening walls 28 for driving engagement between the two to enable the lock handle 102 to rotate the locking mechanism hub 88 and retract the latch or deadbolt from the locked to the unlocked position, and upon release of the force in the one direction, the handle 102 returns to the neutral position by urging of the springs 52, 54 and the latch or deadbolt returns to the locked position. Upon application of force in the other direction to the handle 102 while in the neutral position, the handle 102 partially rotates in the one direction about the axis 300 (shown in FIG. 1) from the neutral position to the predetermined angular position while flexing the springs 52, 54 without causing the hub 88 to rotate and, upon reaching the predetermined angular position and continuing application of the force, the connector male portion projections 66 contact the female portion opening walls 28 so that the male portion projections mate with the female portion opening walls and the handle is prevented from further rotation, without retracting the latch or deadbolt, and upon release of the force in the other direction, the handle 102 returns to the neutral position by urging of the springs 52, 54.

The connector male portion 60 shown in FIGS. 8A-8E includes a body 160 and an arm or projection 66 extending radially from the body for interaction with the walls 28 of the opening of the connector female portion 20. The female portion 20 opening has spaced, parallel walls between 28 which the male portion 60 is disposed. The male portion 60 can be secured to the handle 102 and the female portion 20 can be secured to the hub 88, or vice-versa.

The connector male 60 and female 20 portions are positioned between the lock hub 88 and the handle 102. The connector male portion 60 is rotatable relative to the female portion 20 about the axis 300 from a first neutral position by rotation of the handle 102. The male projections 66 and opening walls 28 are configured such that after the male portion 60 is partially rotated about the axis 300 in either direction with respect to the other, the male portion projections 66 contact the female portion opening walls 28 so that the male portion projections 66 mate with the female portion opening walls 28 for driving engagement between the two to enable the lock handle 102 to rotate the locking mechanism hub 88. Before the projections 66 contact the opening walls 28, there is lost motion there between, so that there is a lag between rotation of the male portion 60 and the female portion 20 while the handle 102 turns.

Figure 16:
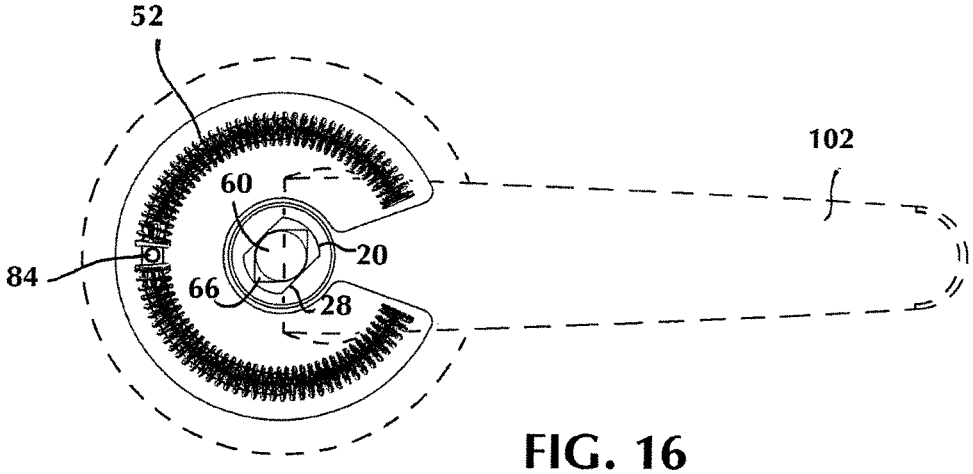
FIGS. 16-18 are front cut-away views of a method of using the anti-ligature lever according to the present invention.

In a method of using the anti-ligature lever 10, the handle 102 is in the neutral position as shown in FIG. 16. The handle 102 is in the horizontal position, the spindle projections 66 are centered between adapter bushing walls 28, the compression spring 52, 54 are each in an unbiased state with bias fastener 84 applying little or no force on the springs 52, 54.

Figure 17:
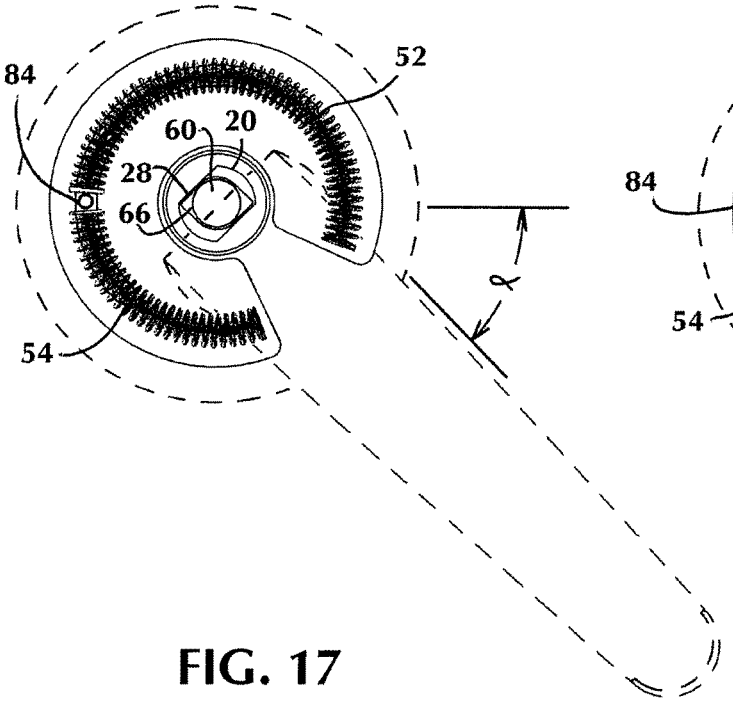

FIG. 17 shows the handle 102 moved to a second position at an angle α to the horizontal. The spindle projections 66 contact the adapter bushing wall 28 but exert no force on the adapter bushing 20. Spring 54 is compressed, exerting a small amount of force to return the handle 102 to the neutral position. The force is not sufficient to allow ligature material such as clothing or belt to stay attached to the handle 102 if force is applied to the ligature material or handle.

Figure 18:
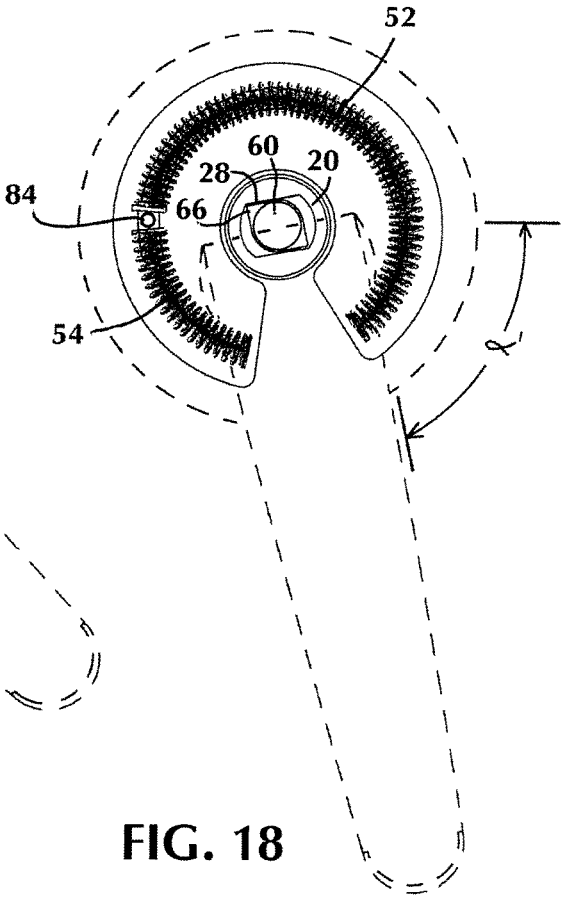

FIG. 18 shows the handle 102 moved to a third position at an angle α' to the horizontal. The spindle projections 66 contact the adapter bushing wall 28 and exert sufficient force on the adapter bushing 20 to overcome the internal forces of the locking hub 88 and rotate the adapter bushing 20 and locking hub 88. Spring 54 is further compressed, exerting a larger force to return the handle 102 to the neutral position.

Figure 19:
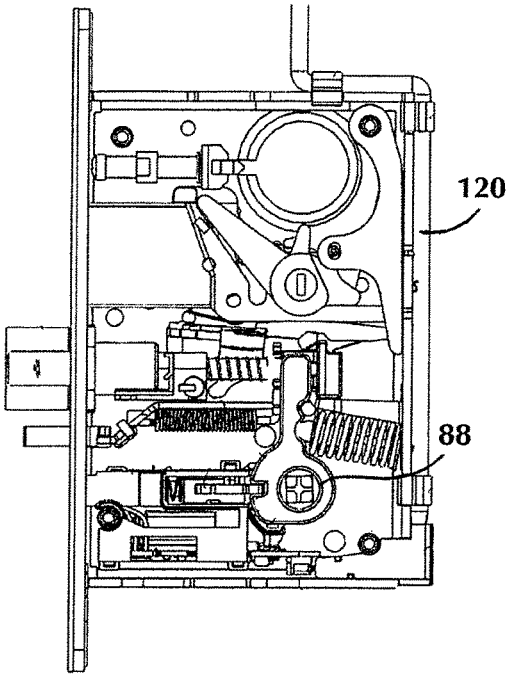
FIG. 19 is a side elevational view of a mortise lock engagable with the anti-ligature lever.
Figure 20:
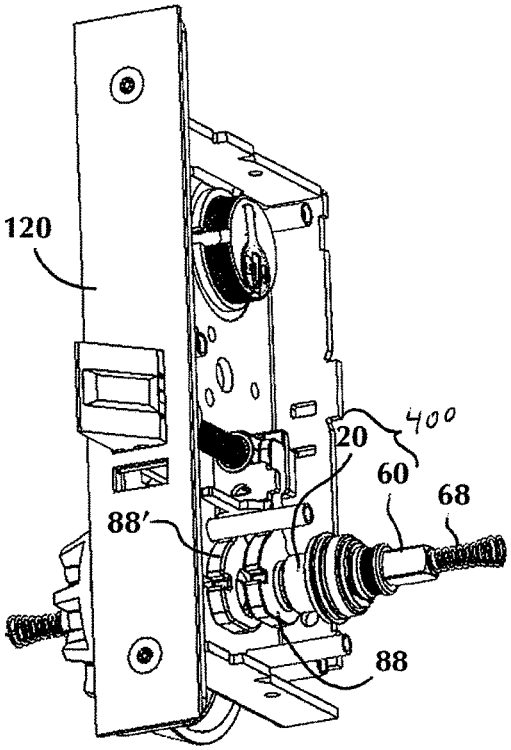
FIG. 20 is a perspective view of the mortice lock with the connector including adapter bushing, portions of the adapter plate and spindle.
Figure 21:
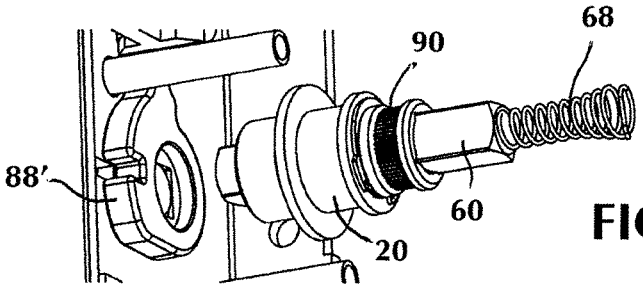
FIG. 21 is a close-up perspective view of the mortice lock with the connector including adapter bushing, bushing and spindle.
Figure 22:
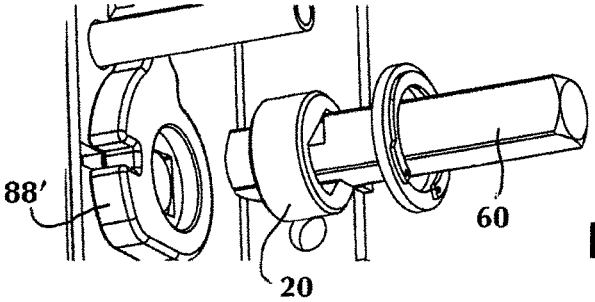
FIG. 22 is a close-up perspective view of the mortice lock with the connector including adapter bushing and spindle.

FIG. 19 is a side elevational view of a mortise lock to which the anti-ligature lever may be attached. FIG. 20 is a perspective view of the mortise lock 120 with the connector 400 including adapter bushing 20 and spindle 60. The adapter bushing 20 is engaged with lock hub 88. FIGS. 21 and 22 eliminate the locking hub 88 for clarity and opposing hub 88' on the opposite side of the mortise lock 120 is shown. Bushing 90 and spring 68 are included in FIGS. 20 and 21.

Figure 23:
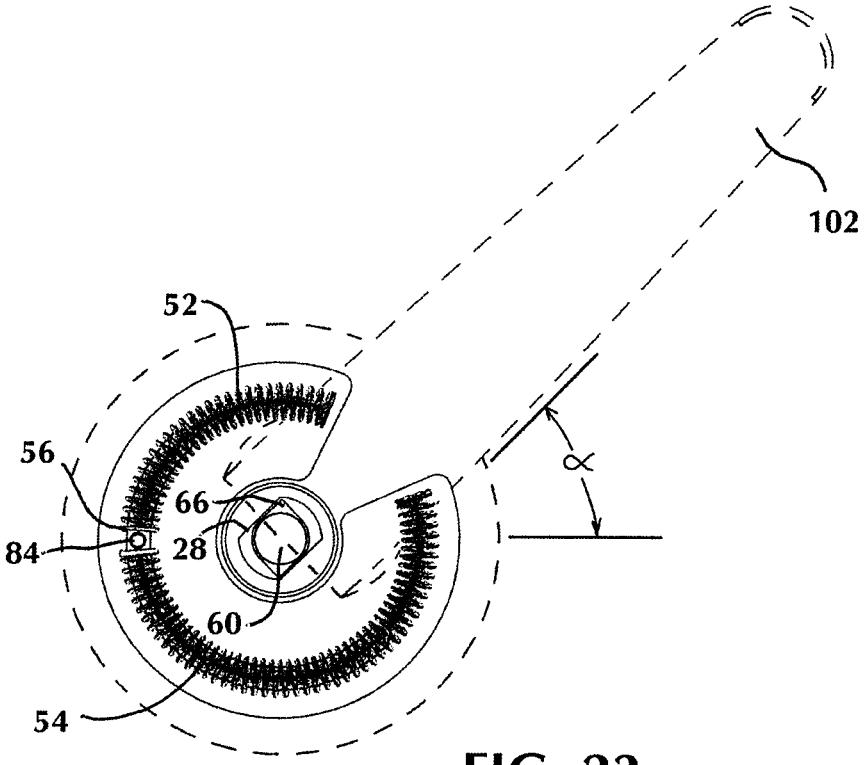
FIG. 23 is a front cut-away view of the anti-ligature lever moved to an upward position.

FIG. 23 is a front cut-away view of the anti-ligature lever 10 moved to an upward position. The handle 102 may be rotated to a first upward angle α in a counter-clockwise direction, compressing spring 52 which lightly urges the handle 102 back to the neutral position. In the position shown, the spindle projections 66 contact the adapter bushing walls 28. The handle 102 cannot be further rotated in the counter-clockwise direction since the hub on a standard mortise lock will not rotate further in the counter-clockwise direction, preventing the adapter bushing 20 from further rotating.

The invention as described above provides an anti-ligature lock having a door handle that does not allow the end of a ligature to be secured to the handle. The invention also provides an anti-ligature lock having a door handle which does not resist rotational movement when the lever is at or near the horizontal position.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An anti-ligature lock comprising:

a locking mechanism for retracting a latch between a locked and an unlocked position, the lock mechanism having a hub rotatable about an axis;

a lock handle rotatable about the axis and operatively connected to the hub to rotate the hub and retract the latch between the locked and the unlocked positions;

a connector between the hub and the lock handle and rotatable about the axis, the connector having a female portion having an opening with walls elongated in a direction normal to the axis and a male portion having projections extending in opposite directions normal to the axis, the male portion extending within the female portion opening and permitting a range of motion from a neutral position wherein one of the male or female portion may be partially rotated in either direction about the axis with respect to the other of the male or female portion without the male portion projections contacting the female portion opening walls, the male portion and opening walls being configured such that after the male or female portion are partially rotated about the axis in either direction with respect to the other beyond the range of motion from the neutral position, the male portion projections contact the female portion opening walls so that the male portion projections mate with the female portion opening walls for driving engagement between the two to enable the lock handle to rotate the locking mechanism hub; and a first resilient member disposed within a cartridge operably coupled to the lock handle and normally biasing the lock handle toward the neutral position, the first resilient member permitting the lock handle, upon application of force, to partially rotate in either direction about the axis from the neutral position to a predetermined angular position within the range of motion, and wherein upon release of the force, the lock handle returns to the neutral position by return of the first resilient member to a resting position; and the cartridge comprising:

a cartridge housing having an arcuate channel extending therethrough, the first resilient member disposed in a first portion of the arcuate channel, the cartridge housing being rotatable with respect to a door; and a cartridge housing plate secured to the cartridge housing and at least partially covering the cartridge housing arcuate channel, the cartridge housing plate including an arcuate slot adjacent the cartridge housing arcuate channel, wherein the first resilient member slidingly engages the arcuate channel and the arcuate slot, the cartridge housing plate securable to the lock handle;

wherein a lack of resistance to force applied to the lock handle in either rotational direction when the lock handle is in the neutral position prevents attachment of a ligature thereto.

2. The lock according to claim 1, wherein, upon application of force in one direction to the handle while in the neutral position, the handle partially rotates in the one direction about the axis from the neutral position to the predetermined angular position while flexing the first resilient member without causing the hub to rotate and, upon reaching the predetermined angular position and wherein upon continuing application of the force beyond rotation of the lock handle to the predetermined angular position, the connector male portion projections contact the female portion opening walls so that the male portion projections mate with the female portion opening walls for driving engagement between the two to enable the lock handle to rotate the locking mechanism hub and retract the latch or deadbolt from the locked to the unlocked position, and upon release of the force in the one direction, the handle returns to the neutral position by urging of the first resilient member and the latch or deadbolt returns to the locked position.

3. The lock according to claim 1 including a second resilient member disposed in a second portion of the cartridge housing arcuate channel and slidingly engageable with the arcuate channel and the arcuate slot, the second resilient member resisting rotation of the lock handle in the opposite direction as the first resilient member.

4. The lock according to claim 3 wherein the resilient members are springs.

5. The lock according to claim 1 wherein, upon application of force in the other direction to the handle while in the neutral position, the handle partially rotates in the one direction about the axis from the neutral position to the predetermined angular position without causing the hub to rotate and, upon reaching the predetermined angular position and continuing application of the force, the connector male portion projections contact the female portion opening walls so that the male portion projections mate with the female portion opening walls and the handle is prevented from further rotation, without retracting the latch or deadbolt, and upon release of the force in the other direction, the handle returns to the neutral position.

6. The lock according to claim 1 wherein, upon application of force in the other direction to the handle while in the neutral position, the handle partially rotates in the one direction about the axis from the neutral position to the predetermined angular position while flexing the first resilient member without causing the hub to rotate and, upon reaching the predetermined angular position and continuing application of the force, the connector male portion projections contact the female portion opening walls so that the male portion projections mate with the female portion opening walls and the handle is prevented from further rotation, without retracting the latch or deadbolt, and upon release of the force in the other direction, the handle returns to the neutral position by urging of the first resilient member.

7. A lock connector for use between a lock hub and a lock handle, the lock connector comprising:

a connector adapter bushing including:

a cylindrical base portion having a central axis and an opening with walls extending in a first direction normal to the central axis, the walls including substantially cylindrical portions and a pair of substantially flat portions between the cylindrical portions; and a male portion extending from the cylindrical base portion in a second direction opposite the opening, the male portion engageable with a door lock hub for sliding a door latch from a door securing position; and an elongated spindle having a first spindle end engageable with the lock handle and a second spindle end opposite the first spindle end, the second spindle end extending within the cylindrical base portion opening and having a neutral position wherein the spindle may be partially rotated in either direction about the axis with respect to the base portion without rotating the base portion, wherein the second spindle end includes projections which contact the cylindrical base portion opening pair of substantially flat portions subsequent to the spindle being partially rotated in either direction, and wherein further rotation of the spindle rotates the connector adapter bushing for sliding the door latch from the door securing position.

8. The lock connector according to claim 7 wherein the second spindle end and opening walls are configured such that after the second spindle end is partially rotated about the axis in either direction with respect to the base portion, a pair of spindle projections extending perpendicular to the central axis on the second spindle end contact the base portion opening flat walls so that the projections mate with the base portion opening flat walls for driving engagement between the spindle and the adapter bushing to enable the lock handle to rotate the door lock hub.

9. A cartridge for a door lock for mounting on a door, the cartridge comprising:

a cartridge housing having an arcuate channel extending therethrough, the cartridge housing being rotatable with respect to the door;

a first spring disposed in a first portion of the cartridge housing arcuate channel;

a second spring disposed in a second portion of the cartridge housing arcuate channel; and a cartridge housing plate secured to the cartridge housing and at least partially covering the arcuate channel, the cartridge housing plate including an arcuate slot adjacent the cartridge housing arcuate channel, wherein the first and second springs slidingly engage the arcuate channel and the arcuate slot, the cartridge housing plate securable to a door handle, wherein the cartridge is adapted to engage a fastener stationary with respect to the door, the fastener extending into the arcuate channel between adjacent ends of the first spring and the second spring, the cartridge having a neutral angular position with respect to the door when no external forces are applied to the cartridge; and wherein the cartridge may be rotated by a force whereby one of the springs is compressed and the cartridge returns to the neutral position when the force is removed.

10. The cartridge according to claim 9 wherein the fastener extends from the door lock housing, through the cartridge plate arcuate slot and into the arcuate channel.

11. The cartridge according to claim 9 including a cap disposed on adjacent ends of the resilient members for engaging a fastener.

12. An anti-ligature lock comprising:

a locking mechanism for retracting a latch between a locked and an unlocked position, the lock mechanism having a hub rotatable about an axis;

a lock handle rotatable about the axis and operatively connected to the hub to rotate the hub and retract the latch between the locked and the unlocked positions;

a connector between the hub and the lock handle and rotatable about the axis, the connector including a connector adapter bushing having:

a cylindrical base portion having a central axis and an opening with walls extending in a first direction normal to the central axis, the walls including substantially cylindrical portions and a pair of substantially flat portions between the cylindrical portions; and a male portion extending from the cylindrical base portion in a second direction opposite the opening, the male portion engageable with the hub for retracting the latch from the locked position; and the connector further including:

an elongated spindle having a first spindle end engageable with the lock handle and a second spindle end opposite the first spindle end, the second spindle end extending within the adapter bushing cylindrical base portion opening and having a neutral position wherein the spindle may be partially rotated in either direction from the neutral position about the axis with respect to the base portion, wherein the second spindle end includes projections which contact the cylindrical base portion opening pair of substantially flat portions subsequent to the spindle being partially rotated in either direction, and wherein further rotation of the spindle rotates the connector adapter bushing for retracting the latch from the locked position; and at least one resilient member operably coupled to the lock handle and normally biasing the lock handle toward a neutral position, the at least one resilient member permitting the lock handle, upon application of force, to partially rotate in either direction about the axis from the neutral position to a predetermined angular position and, upon release of the force, return to the neutral position;

wherein a lack of resistance to force applied to the lock handle in either rotational direction when the lock handle is in the neutral position prevents attachment of a ligature thereto.

13. The anti-ligature lock of claim 12 including a cartridge comprising:

a cartridge housing having an arcuate channel extending therethrough, the cartridge housing being rotatable with respect to the door;

a first spring disposed in a first portion of the cartridge housing arcuate channel, the first spring comprising one of the at least one resilient members; a second spring disposed in a second portion of the cartridge housing arcuate channel; and a cartridge housing plate secured to the cartridge housing and at least partially covering the arcuate channel, the cartridge housing plate including an arcuate slot adjacent the cartridge housing arcuate channel, wherein the first and second springs slidingly engage the arcuate channel and the arcuate slot, the cartridge housing plate securable to a door handle, wherein the cartridge is adapted to engage a fastener stationary with respect to the door, the fastener extending into the arcuate channel between adjacent ends of the first spring and the second spring, the cartridge having a neutral angular position with respect to the door when no external forces are applied to the cartridge; and wherein the cartridge may be rotated by a force whereby one of the springs is compressed and the cartridge returns to the neutral position when the force is removed.

14. A method for using an anti-ligature lock comprising:

providing a locking mechanism for retracting a latch between a locked and an unlocked position, the lock mechanism having a hub rotatable about an axis;

providing a lock handle rotatable about the axis and operatively connected to the hub to rotate the hub and retract the latch between the locked and the unlocked positions;

providing a resilient member operably coupled to the lock handle and normally biasing the lock handle toward a neutral position, the resilient member being disposed within a cartridge rotatable with the lock handle and permitting the lock handle, upon application of force, to partially rotate in either direction about the axis from a neutral position to a predetermined angular position and, upon release of the force, return to the neutral position, the cartridge comprising:

a cartridge housing having an arcuate channel extending therethrough, the resilient member disposed in a first portion of the arcuate channel, the cartridge housing being rotatable with respect to a door; and a cartridge housing plate secured to the cartridge housing and at least partially covering the cartridge housing arcuate channel, the cartridge housing plate including an arcuate slot adjacent the cartridge housing arcuate channel, wherein the resilient member slidingly engages the arcuate channel and the arcuate slot, the cartridge housing plate securable to the lock handle;

providing a connector between the hub and the lock handle and rotatable about the axis, the connector having a female portion having an opening with walls elongated in a direction normal to the axis and a male portion having projections extending in opposite directions normal to the axis, the male portion extending within the female portion opening and having a neutral position;

partially rotating the lock handle in either direction about the axis from the neutral position to apply force to the resilient member in a first direction and without the male portion projections contacting the female portion opening walls, wherein a lack of resistance to force applied to the lock handle in either rotational direction when the lock handle is in the neutral position prevents attachment of a ligature thereto; and upon release of the lock handle, returning the lock handle to the neutral position by release of the force applied to the resilient member.

15. The method according to claim 14, wherein, upon reaching the predetermined angular position and continuing application of the force, the connector male portion projections contact the female portion opening walls so that the male portion projections mate with the female portion opening walls for driving engagement between the two to enable the lock handle to rotate the locking mechanism hub and retract the latch or deadbolt from the locked to the unlocked position.

16. A lock comprising:

a locking mechanism having a hub rotatable about an axis to retract a latch or deadbolt between locked and unlocked positions;

a lock handle rotatable by a user about the axis and operatively connected to the hub to rotate the hub and retract a latch or deadbolt between locked and unlocked positions;

a resilient member operably coupled to the lock handle and normally biasing the lock handle toward a neutral position, the resilient member being disposed within a cartridge rotatable with the lock handle and permitting the lock handle, upon application of force, to partially rotate in either direction about the axis from the neutral position to a predetermined angular position and, upon release of the force, return to the neutral position; and the cartridge comprising:

a cartridge housing having an arcuate channel extending therethrough, the resilient member disposed in a first portion of the arcuate channel, the cartridge housing being rotatable with respect to a door; and a cartridge housing plate secured to the cartridge housing and at least partially covering the cartridge housing arcuate channel, the cartridge housing plate including an arcuate slot adjacent the cartridge housing arcuate channel, wherein the resilient member slidingly engages the arcuate channel and the arcuate slot, the cartridge housing plate securable to the lock handle.

* * * * *